US008839884B2

(12) United States Patent
Küttel et al.

(10) Patent No.: US 8,839,884 B2
(45) **Date of Patent: *Sep. 23, 2014**

(54) DIRECT MODULAR TOP DRIVE WITH PIPE HANDLER MODULE AND METHODS

(71) Applicant: Canrig Drilling Technology Ltd., Houston, TX (US)

(72) Inventors: Beat Küttel, Spring, TX (US); Randall S. Pyrch, Montgomery, TX (US); Faisal J. Yousef, Houston, TX (US); Alan S. Richardson, The Woodlands, TX (US); Greg Kostiuk, Houston, TX (US)

(73) Assignee: Canrig Drilling Technology Ltd., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/926,536

(22) Filed: Jun. 25, 2013

(65) Prior Publication Data

US 2013/0299247 A1 Nov. 14, 2013

Related U.S. Application Data

(63) Continuation of application No. 13/412,918, filed on Mar. 6, 2012, now Pat. No. 8,499,858, and a continuation of application No. 12/903,764, filed on Oct. 13, 2010, now Pat. No. 8,151,909, and a continuation of application No. 11/613,685, filed on Dec. 20, 2006, now Pat. No. 7,828,085.

(60) Provisional application No. 60/752,116, filed on Dec. 20, 2005.

(51) Int. Cl.

| | |
|---|---|
| ***E21B 3/00*** | (2006.01) |
| ***E21B 19/00*** | (2006.01) |
| ***E21B 19/16*** | (2006.01) |

(52) U.S. Cl.

CPC ..... *E21B 19/00* (2013.01); *E21B 19/16* (2013.01)

USPC ..... 175/162; 175/203; 166/77.51

(58) Field of Classification Search

USPC ..... 175/87, 162, 203; 166/77.51

See application file for complete search history.

(56) References Cited

U.S. PATENT DOCUMENTS

| | | | |
|---|---|---|---|
| 2,937,008 | A | 5/1960 | Whittle |
| 4,791,999 | A | 12/1988 | Skeie |
| 4,813,493 | A | 3/1989 | Shaw et al. |
| 4,899,959 | A | 2/1990 | Weiler |

(Continued)

OTHER PUBLICATIONS

ISA/US, International Search Report and Written Opinion of the International Searching Authority, PCT/US2006/62414, mailed Oct. 15, 2007.

(Continued)

*Primary Examiner* — Giovanna Wright

(74) *Attorney, Agent, or Firm* — Haynes and Boone, LLP

(57) ABSTRACT

A top drive system with a plurality of top drive modules, which are configured to be quickly exchanged. The top drive modules may include any or all of the following: a main body module, a gearbox module, a drive motor module, a pipe handler module, an upper fluid module, a lower well control valve module, a block interface module, a retract system interface frame module, a cooling system module, a work platform guard module, and a quill saver sub module. Alternatively, the top drive may comprise a first top drive and a second top drive which are configured to be quickly exchanged.

21 Claims, 4 Drawing Sheets

(56) References Cited

U.S. PATENT DOCUMENTS

| | | | |
|---|---|---|---|
| 5,921,329 | A | 7/1999 | Armstrong |
| 6,056,071 | A | 5/2000 | Scott et al. |
| 6,561,155 | B1 | 5/2003 | Williams |
| 6,725,949 | B2 | 4/2004 | Seneviratne |
| 7,270,189 | B2 | 9/2007 | Brown et al. |
| 7,401,664 | B2 | 7/2008 | Wells et al. |
| 7,500,531 | B2 | 3/2009 | Williams et al. |
| 7,673,675 | B2 | 3/2010 | Carr et al. |
| 7,743,853 | B2 | 6/2010 | Rudshaug et al. |
| 7,748,473 | B2 | 7/2010 | Wells et al. |
| 7,828,085 | B2 | 11/2010 | Kuttel et al. |
| 8,151,909 | B2 | 4/2012 | Kuttel et al. |
| 2005/0279507 | A1 | 12/2005 | Folk et al. |
| 2006/0096751 | A1 | 5/2006 | Brown et al. |
| 2007/0039758 | A1 | 2/2007 | Klipstein |
| 2007/0140801 | A1 | 6/2007 | Kuttel et al. |
| 2007/0209878 | A1 | 9/2007 | Czechowski et al. |
| 2007/0240908 | A1 | 10/2007 | Brown et al. |
| 2012/0160570 | A1 | 6/2012 | Kuttel et al. |

OTHER PUBLICATIONS

WIPO, International Preliminary Report on Patentability, PCT/US2006/62414, issued Jun. 24, 2008.

European Patent Office, European Search Report dated Feb. 27, 2012, Application No. 06846724.0-1266/1984137 PCT/. US2006062414, 7 pages.

DIRECT MODULAR TOP DRIVE WITH PIPE HANDLER MODULE AND METHODS

CROSS-REFERENCE TO RELATED APPLICATIONS

This application is a continuation of U.S. patent application Ser. No. 13/412,918, filed Mar. 6, 2012, now allowed, which is a continuation of U.S. patent application Ser. No. 12/903,764, filed Oct. 13, 2010, now U.S. Pat. No. 8,151,909, issued Apr. 10, 2012, which claims priority to U.S. application Ser. No. 11/613,685, filed Dec. 20, 2006, now U.S. Pat. No. 7,828,085, issued Nov. 9, 2010, which claims the benefit of U.S. Application No. 60/752,116, filed Dec. 20, 2005, the contents of each of which are hereby incorporated herein by express reference thereto.

BACKGROUND OF THE INVENTION

Increasingly, drilling contractors are using top drives instead of Kellies or Kelly bushings. A top drive is a drilling tool that hangs from the traveling block, and has one or more motors to power a drive shaft to which crewmembers attach the drill string. Because the top drive's motor can rotate the drill string, no Kelly or Kelly bushing is required. The top drive also incorporates a spinning capability and a torque wrench. In addition the top drive has elevators on links. The benefits of top drives may include the ability to work in 90 feet increments rather than the 30 feet increments to which a Kelly is typically limited. That is, a joint of tubular is typically 30 feet long. Thus, a top drive allows an operator to work with 3 joints of tubular per increment of a given operation. For example, top drives allow operators to assemble three-joint (90 feet) stands of tubular off the critical path to save time. Similarly, in some instances, such as, for example, applications involving horizontal or highly deviated well bores, it may be desirable to remove tubular from a well bore by a process known as back reaming. A top drive allows operators to back ream tubular from a well bore in three joint stands of tubular, which may then be racked intact.

On a drilling rig, the critical path includes all tasks and equipment required to continue drilling without interruption. When a task or equipment on the critical path is delayed, the entire drilling operation is delayed. Thus, because mechanical devices require some amount of repair and/or maintenance, many drilling rig critical path components are maintained in redundant quantities to decrease downtime caused by inevitable repair and maintenance. Conventionally, top drives have been an exception to this principle of redundancy. Because top drives are generally on the critical path, top drives create the potential for single point failure—that is, if the top drive goes down, the entire drilling operation stalls, rendering the entire rig nonoperational until the top drive can be brought back online Generally, diagnostics occur in the critical path before any repairs can be done, causing additional delay in the operation before repair even begins. Likewise, maintenance operations can fall within the critical path, creating downtime.

SUMMARY OF THE INVENTION

The present invention relates to the field of oil or gas well drilling and more particularly to a method and apparatus for drilling a well and handling tubulars.

In a first aspect, the present disclosure includes a top drive system including a top drive comprising a plurality of top drive modules on a critical path, the top drive modules comprising a motor module and a pipe handler module, wherein the motor module and the pipe handler module are removable from the top drive independent of each other; and a replacement top drive module that is not on the critical path, wherein the replacement top drive module is configured to be readily exchanged with at least one of the plurality of top drive modules on the critical path.

In a second aspect, the present disclosure includes a top drive system including a top drive including a plurality of top drive modules on a critical path, the top drive modules including a motor module and a pipe handler module, wherein the motor module and the pipe handler module are removable from the top drive independent of each other; and a replacement top drive module that is not on the critical path, wherein the replacement top drive module is configured to be readily exchanged with at least one of the plurality of top drive modules on the critical path, and wherein the replacement top drive module is preconfigured for a different drilling application than at least one of the plurality of top drive modules on the critical path.

In a third aspect, the present disclosure includes a top drive system including a top drive including a plurality of motor modules and one or more top drive modules including at least a pipe handler module adapted to be on or off critical path; a plurality of circulators adapted to provide cooling to at least the plurality of motor modules; and a common duct communicably coupled to each of the plurality of circulators and at least each of the plurality of motor modules, wherein the common duct extends through a support structure of the top drive and is operable to allow continued cooling from at least one non-failing circulator when one of the plurality of circulators fails.

In a fourth aspect, the present disclosure includes a method of increasing drilling efficiency that includes by providing a top drive including a pipe handler module and at least one other top drive module, wherein said plurality of top drive modules is on a critical path, and wherein each of the plurality of top drive modules includes at least one mechanical connection to the top drive, the at least one mechanical connection including at least one of a dovetail slide-on, a multi-unit retract system, an eccentric jam device, a keyway slot, pilot ring, clamp, a flange, pin, or slot; providing a replacement top drive module off the critical path; replacing at least one of the plurality of top drive modules with the replacement top drive module such that the replacement top drive module is on the critical path and the replaced at least one of the plurality of top drive modules is off the critical path.

In a fifth aspect, the present disclosure includes a method of increasing drilling efficiency that includes by providing a top drive including a pipe handler module and at least one other top drive module, wherein the pipe handler module and a first of at least one other top drive modules is on a critical path, a second of the at least one other top drive modules is off the critical path, a third of the at least one other top drive modules is on the critical path and can operate when the first and second top drive modules are not operating; and replacing the pipe handler module or the first of the at least one other top drive modules with the second top drive module such that the second top drive module is on the critical path and the replaced pipe handler module or first other top drive module is off the critical path.

It should be understood that each of the embodiments herein may be used alternatively or additively, as may be appropriate.

BRIEF DESCRIPTION OF THE DRAWINGS

The present invention may be better understood by reading the following description of non-limitative embodiments with reference to the attached drawings wherein like parts of each of the several figures are identified by the same referenced characters, and which are briefly described as follows.

DETAILED DESCRIPTION OF THE PREFERRED EMBODIMENTS

Figure 1:
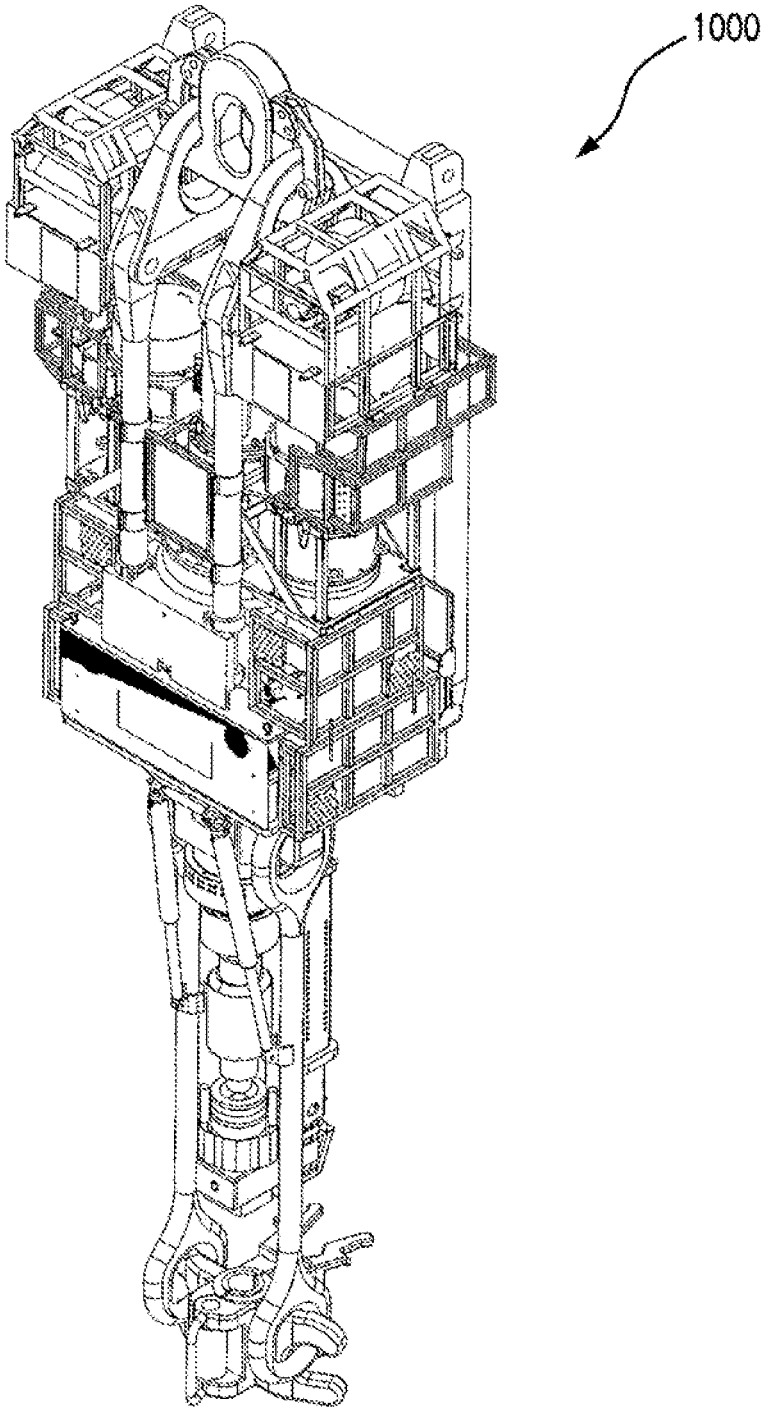
FIG. 1 is a perspective view of an embodiment of the top drive system having the following top drive modules: a main body, a gearbox, two drive motor modules, a pipe handler, an upper fluid module, a lower well control valve, a block interface, two work platform guard modules, two cooling system modules, a quill saver sub module, and a retract system interface frame module.
Figure 2:
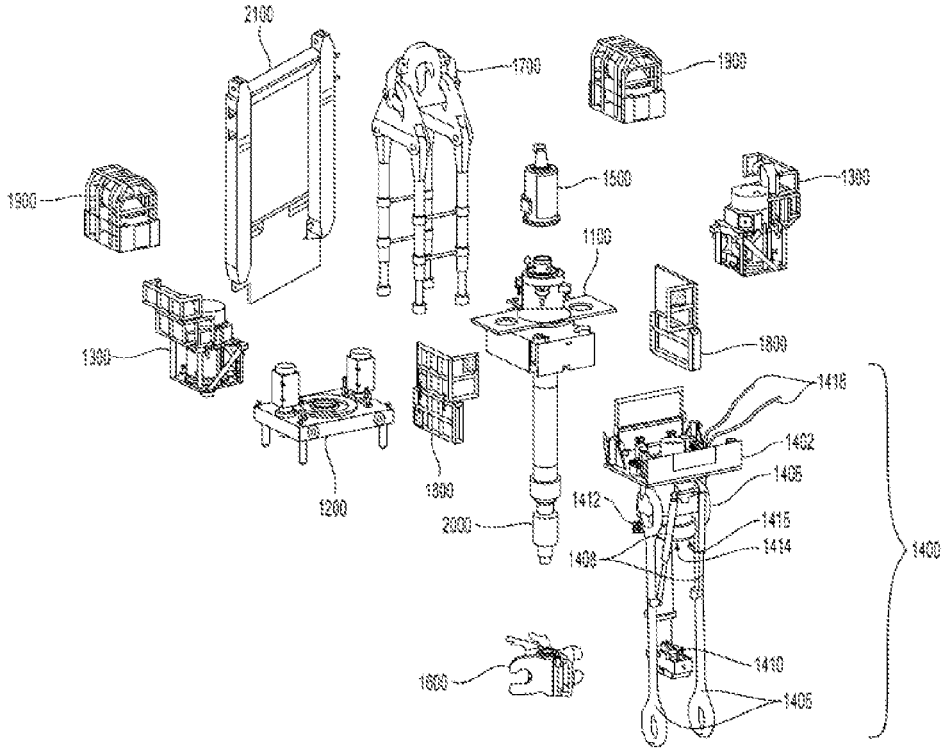
FIG. 2 is an exploded view of an embodiment of the top drive system of FIG. 1.

The present invention relates to the field of oil or gas well drilling and more particularly to a method and apparatus for drilling a well and handling tubulars. Referring now to FIG. 1, according to one embodiment of the invention, a top drive system 1000 is provided having a number of top drive modules. Referring now to FIG. 2, in a particular embodiment, the top drive modules may include one or any number of the following: a main body module 1100, a gearbox module 1200, two drive motor modules 1300, a pipe handler module 1400, an upper fluid module 1500, a lower well control valve module 1600, a block interface module 1700, two work platform guard modules 1800, two cooling system modules 1900, a quill saver sub module 2000, and a retract system interface frame module 2100. Each of these modules may have components and features as listed below.

When it becomes necessary to perform maintenance on a particular component of a modular top drive system of the present invention, for example top drive system 1000, due to failure or routine maintenance, a top drive module containing that component may be quickly replaced with a corresponding top drive module that is already in proper working order. This allows operations to continue without significant interruption. As operations continue, maintenance and/or repairs can be performed on the component off the critical path, such that the top drive module that was removed can be used when the need arises. Alternatively, the entire top drive module may be sent off site for repair or the top drive module may be disposed of.

A further aspect of a modular top drive of the present invention is the ability for dual activities to occur simultaneously. By way of example, and not of limitation, the replacement of a drive motor on a conventional top drive is a lengthy process due to the serial nature of the replacement steps. That is, the electrician may need to disconnect the drive motors electrical connections before the mechanic may remove the drive motor. Then the mechanic may align and install the replacement drive motor. Then the electrician may make the electric connections to the new drive motor. Conversely, a modular top drive of the present invention may be assembled such that the electrical connections are physically located far enough away from the mechanical connections such that the electrician and the mechanic may perform their tasks in parallel, that is, at the same time or nearly the same time, hence reducing downtime.

Interchangeable top drive modules may also be desirable for reasons beyond maintenance or repair. For instance, different top drive modules may be used for different drilling and/or make-up configurations. In certain drilling applications, different drill speeds may be required. Rather than using a variable or multi-speed gearbox, the different speeds may be provided by exchanging gearbox modules with different single speed gear arrangements that are simpler and more reliable. Similarly, different tubular diameters may be accommodated by exchanging lower well control valve modules. Similarly, different drive motor modules may be better suited to different applications such as coring, drilling, and workover. Other advantages of different modular configurations will be apparent, with the benefit of this disclosure, to a person of ordinary skill in the art.

Depending on the specific top drive system 1000 and the specific conditions, there may be any number of top drive modules. For example, a single top drive module may be used. In this example, the top drive module may include the entire top drive system 1000, and be interchangeable with another complete top drive system module 1000. This configuration requires no diagnostics to determine which component is problematic until the top drive system 1000 is off-line. Similarly, a short module replacement time simplifies the repair or replace decision-making process such that a module may be quickly replaced and diagnostics conducted on the replaced module off the critical path. If replacing the entire top drive system 1000 is not practical, or is otherwise not desired, multiple top drive modules may be used. The components of the top drive system 1000 may be grouped into modules in any number of ways, and the configuration of the individual modules should not be limited by the specific embodiment(s) discussed below.

The top drive modules of a modular top drive system of the present invention may be coupled according to a variety of techniques, so long as the techniques allow for quick change capability of the modules of a modular top drive. Additionally, it is desirable that the connections readily allow for the exchange of one top drive module for a similar top drive module. Furthermore, it may be desirable for the connection mechanisms to allow for vertically lifting and lowering of the top drive modules as they are connected and disconnected to a modular top drive system. Suitable connection techniques include, but are not limited to, a multi-unit retract system, bolts, inserts and pins, dovetail slide-ons, eccentric jam devices, keyway slots, pilot rings and clamps, splined connections, split rings, guide pins, torque arrest mechanisms, O-ring seals, flanges, pins and slots, and any combination thereof. Additionally, a person of ordinary skill in the art will be aware, with the benefit of this disclosure, of other techniques for coupling the modules of a modular top drive system.

In one exemplary embodiment, shown in FIG. 2, a top drive system 100 may have a main body module 1100, a gearbox module 1200, two drive motor modules 1300, a pipe handler module 1400, an upper fluid module 1500, a lower well control valve module 1600, a block interface module 1700, two work platform guard modules 1800, two cooling system modules 1900, a quill saver sub 2000, and a retract system interface frame module 2100.

The main body module 1100 may serve as a base, and other top drive modules or components may be attached to the main body module 1100, either directly or indirectly, using one or more of the connection techniques described above. The main body module 1100 may have any or all of the following: a top drive housing 1110 (FIG. 3) with mounts for a block interface module 1700; main bearings; a hollow spindle 1120 (FIG. 3), which may be splined for connection to gearbox module 1200; a floating quill 1130 (FIG. 3), which may have 8 inch free float travel and a male spline connection; an upper bearing carrier with motor mounts; a retract system interface frame with blowers for motor cooling; and an auto grease system. Some embodiments may have a self contained splash lubrication system that is itself modular. Similarly, some embodiments, for example top drive system 1000, may have a retract system interface frame that is itself modular. The main body module 1100 may additionally or alternatively include any other components that would typically remain intact when changing out other top drive modules.

The gearbox module 1200 may be quickly attached to, or detached from, the main body module 1100 using one or more of the connection techniques described above. For example, the connection may be via a spline and pins that act as a gravity retention as well as a torque arresting mechanism. This allows the gearbox module 1200 to be completely removed and replaced with another gearbox module 1200, allowing for repair of any components therein off the critical path. The gearbox module 1200 may have any or all of the following: a simple one speed gearbox, which may have a reduction ratio between about 6.890 to 1 and 9.000 to 1; input shafts for one or more coupled drive motors; one or more couplings with guard and drive shaft; inspection view windows; one or more torque keys and quick latch assemblies for easy removal and installation; a splined bull gear to transmit torque to the spindle; and a self-contained gearbox lubrication system. The self-contained gearbox lubrication system may include the following: a dry sump reservoir; a suction strainer; one or more screw pumps and one or more electric motors; one or more filters with visual indicators and remote sensors; a distribution manifold; a remote sensor for sensing oil pressure; and a lube oil cooler with an electric fan. In some embodiments, the gearbox module 1200 may include a multi speed gearbox. In other embodiments, a plurality of single speed gearboxes, which may be quickly interchangeable, may be more preferable than one or more multi-speed gearboxes for reasons of reliability. The gearbox module 1200 may additionally or alternatively include any other components that would typically be associated with the components of the gear system.

The drive motor module 1300 may be quickly attached to, or detached from the main body module 1100 using one or more of the connection techniques described above. This allows the drive motor module 1300 to be completely removed and replaced with another drive motor module 1300. This allows for the repair of components of the drive motor module 1300 to take place off the critical path. The drive motor module 1300 may include one or more motors, such as AC electric motors, GE model GEB-20, 1150 HP; a motor module frame to allow quick installation and removal of the entire drive motor module 1300; a coupling to the gearbox module 1200 for quick alignment or isolation in the event of a failure; a brake system; a programmable logic controller ("PLC") junction box or simple electrical junction box for control and sensors; and a guard and lifting assembly. The brake system may include the following: five (5) disk brake calipers; hydraulic controls; and an auto bleed system. In some embodiments, it may be desirable to locate the electrical connections of drive motor module separate from the mechanical connections, so as to enable dual activities during replacement, maintenance, and/or repair. The drive motor module 1300 may additionally or alternatively include any other components that would typically be associated with the components of the motor system.

The pipe handler module 1400 may be quickly attached to, or detached from the main body module 1100 using one or more of the connection techniques described above. For example, the connection may be made via a slide-on module using split rings as the main connection method, along with guide pins which act as a locating guide and as a torque arrest method. This allows the pipe handler module 1400 to be completely removed and replaced with another pipe handler module 1400. This allows for the repair of components to take place off the critical path. The pipe handler module 1400 may include any or all of the following: a mounting plate 1402; a rotary manifold for hydraulic and air communication 1418; an elevator link support 1406; an integrated link counter balance system 1416; a link tilt assembly 1408; a back-up wrench 1410; a handling frame for ease of movement when removed; and an auto grease system 1412. The mounting plate may include the following: hydraulic valve banks direct mounted to a porting plate to eliminate hoses and leak points; a redundant handler to rotate modules; a redundant handler to lock modules; dual PLC junction boxes with quick connects; and a fold down guard, which may double as a work platform. Some embodiments, for example top drive system 1000, may have one or more fold down guards that are themselves modular, for example, work platform guards 1800. The rotary manifold may include the following: twenty (20) passages with test ports and radial bearings for centralization. The link tilt assembly may have bi-directional hydraulic actuation and float capabilities. The back-up wrench may have quick change capability with driller controlled vertical positioning and include the following: a hydraulic gripper, with a capacity up to 11 inch diameter and 120,000 ft/lb torque; driller controlled vertical positioning; removable die blocks; and a pipe stabbing guide. The pipe handler module 1400 may additionally or alternatively include any other components that would typically be associated with the components of the pipe handling system.

The upper fluid module 1500 may be quickly attached to, or detached from the main body module 1100 using one or more of the connection techniques described above. For example, the bonnet may be bolted or pinned to the main body module via a spline and an O-ring seal connection. Alternatively, a clamp or flange and O-ring seal may be used. This allows the upper fluid module 1500 to be completely removed and replaced with another upper fluid module 1500. This allows for the repair of components to take place off the critical path. The upper fluid module 1500 may include a washpipe assembly with 7500 PSI WP, 4 inch bore; an upper sealing including a wiper, a flinger, a labyrinth seal, and lubrication oil seals for mud exclusion; and a mud line with top access 7500 PSI WP, 4 inch bore. The upper fluid module 1500 may additionally or alternatively include any other components that would typically be associated with the components of the fluid system.

The lower well control valve module 1600 may be quickly attached to, or detached from the main body module 1100 using one or more of the connection techniques described above. For example the connection may be made via the split ring connection of a quill saver sub module 2000. This allows the lower well control valve module 1600 to be completely removed and replaced with another lower well control valve module 1600. This allows for the repair of components to take place off the critical path. The lower well control valve module 1600 may include a splined quill saver sub, for example, quill saver sub module 2000, which may be splined for quick removal, allowing multiple quill connections to match a given drill string. Additionally, a splined quill saver sub, for example, quill saver sub module 2000, may accommodate future and unforeseen drill string connections. The saver sub may have a remote operated lower well control valve; a hydraulic valve actuator; two manual lower well control valves; and connection clamps. Examples and properties of quill saver subs are further disclosed in U.S. application Ser. No. 11/405,940, which is hereby incorporated by reference. The lower well control valve module 1600 may additionally or alternatively include any other components that would typically be associated with the components of the lower well control system.

The block interface module 1700 may be quickly attached to, or detached from the main body module 1100 using one or more of the connection techniques described above. For example, the connection may be made using a pin and slot connection or a split-ring connection. This allows for the repair or inspection of load path components to take place off the critical path. The block interface module 1700 may include four upper links; two link to bail adapters; a block adapter; and four load cell pins. The block interface module 1700 may additionally or alternatively include any other components that would typically be associated with the components of the block system. The block interface module 1700 may be exchanged for another block interface module, for example, when changing rigs.

The cooling system module 1900 may be quickly attached to, or detached from, one or more of the main body module 1100, the drive motor module 1300, and the retract system interface frame module 2100 using one or more of the connection techniques described above. This allows the cooling system module 1900 to be completely removed and replaced with another cooling system module 1900. This allows for the repair of components to take place off the critical path. In some embodiments, cooling system module 1900 may be hinged or otherwise connected to a part of a modular top drive system, for example retract system interface frame module 2100, such that cooling system module 1900 may be rotated away from, for example, drive motor module 1300 to provide enhanced access to the same. The cooling system module 1900 may have one or more circulators, for example a blower and/or a pump, and one or more ducts. In some embodiments, the one or more circulators and the one or more ducts may themselves be modular. The cooling system module 1900 typically uses air to cool. However, any coolant may be used. The cooling system module 1900 may additionally or alternatively include any other components that would typically be associated with the component of the cooling system.

The retract system interface frame module 2100 may be particularly useful when interchanging an entire top drive system 1000. The retract system interface frame module 2100 may have a pin configuration that may interface to a plurality of guide dollies and/or retract systems, such that the retract interface frame module 2100 is interchangeable between derricks. The retract system interface frame module 2100 may contain an auto lube system. The retract system interface frame module 2100 may additionally or alternatively include other components, for example, junction boxes, cooling loops, PLCs, lube systems, filters for lube systems, and the like, to allow for dual activities when replacing the modules of a modular top drive system of the present invention. The retract system interface frame module 2100 may additionally or alternatively include any other components that would typically be associated with the components of the retract system interface frame system.

According to other embodiments of the invention, a modular top drive system of the present invention may be an interchangeable top drive system comprising dual top drive systems such as, for example, top drive system 1000. This enables the operators to trouble-shoot and/or configure the off-line top drive while the other top drive is in operation. The operators may change out a complete top drive. Each of the top drives may have permanently installed service loops. Each top drive may be preconfigured for different drilling and/or make-up configurations.

Another embodiment of the invention relates to different configurations of a modular top drive system. For example, in addition to the example embodiment top drive system 1000, another embodiment may be formed from the following top drive modules: dual coupled main drive motors, quick change IBOP (LWCV), pipe handler module 1400, gearbox module 1200, a lube system, and a back-up wrench. Furthermore, using the principles of modular construction of a top drive system discussed herein, a person of ordinary skill in the art will be aware of numerous additional modular constructions of top drive systems, comprising virtually any number of top drive modules, which may be suited to numerous drilling, casing, and any other tubular handling applications.

Some embodiments of the top drive system 1000 have a motor cooling system. In some embodiments, the cooling system may have modular components, for example, cooling system module 1900. The system may be a cooling system for the one or more main drive motors. It may also have ducts integrated with the top drive support structure, which may include modular or nonmodular frame and/or guard structures, such that the ducts are the interiors of hollow beams of the support structure. One or more circulators may be connected to the one or more motors through a manifold and/or duct system so that any of the one or more circulators may cool any and/or all of the one or more motors. The cooling system may circulate air, or any other coolant. This builds redundancy into the system.

Figure 3:
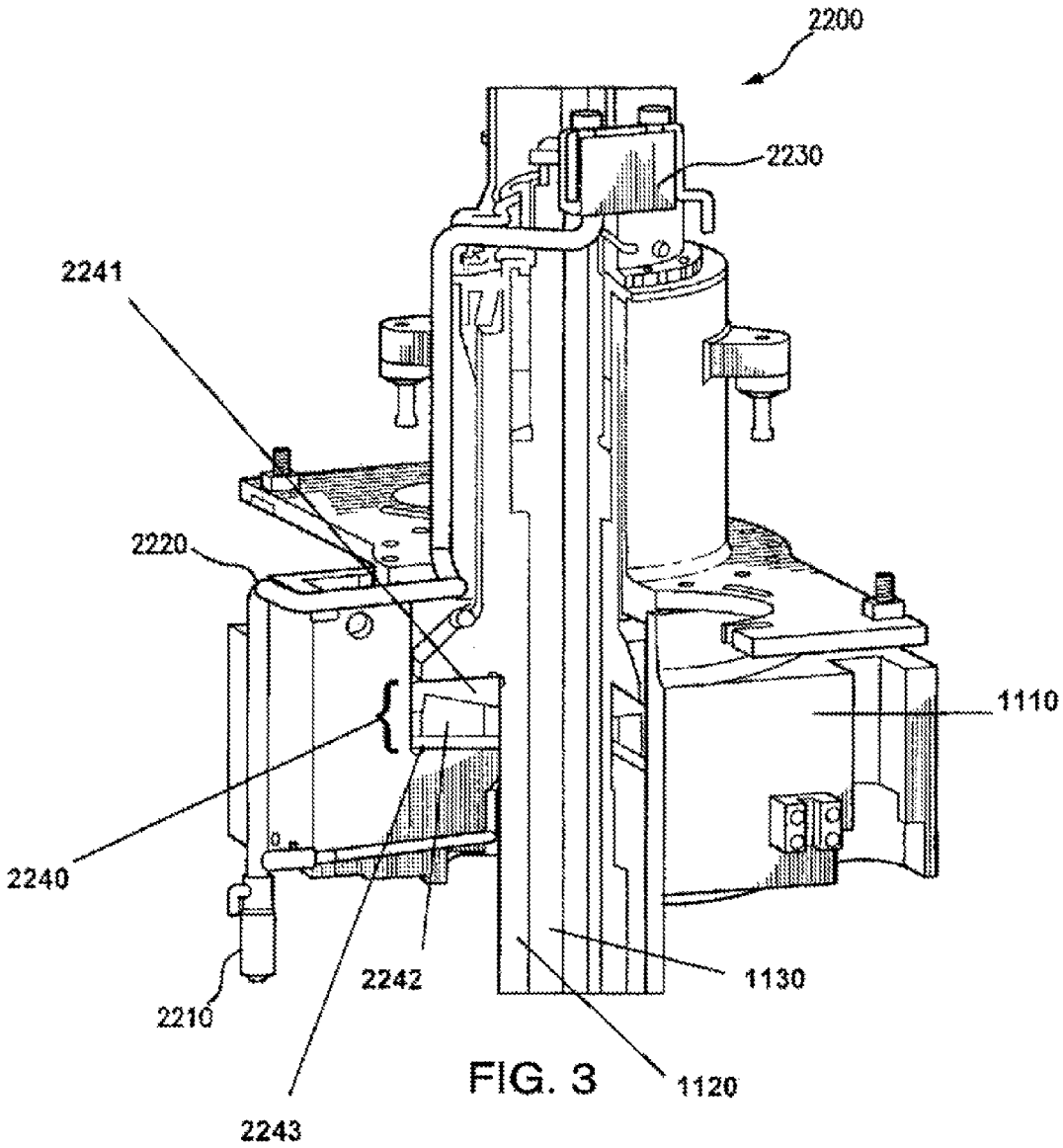
FIG. 3 is a partially cut away perspective view of one embodiment of a bearing lubrication system.

Embodiments such as, for example, top drive system 1000 may also have separate lubrication systems for the gearbox and the bearings. This prevents any wear debris from the gearbox from interacting with, and potentially damaging, the bearings. In the bearing lubrication system, there may be no forced circulation and filtration, and circulation may be achieved through natural convection and gravity. FIG. 3 shows an example embodiment of such a bearing lubrication system 2200. The bearing lubrication system 2200 may include a sump 2210 connected to a riser 2220, which connects to reservoir 2230. Lubricant flows between the riser 2220 and bearings 2240. The bearings 2240 in this example include an upper race 2241, a roller 2242, and a lower race 2243.

Figure 4:
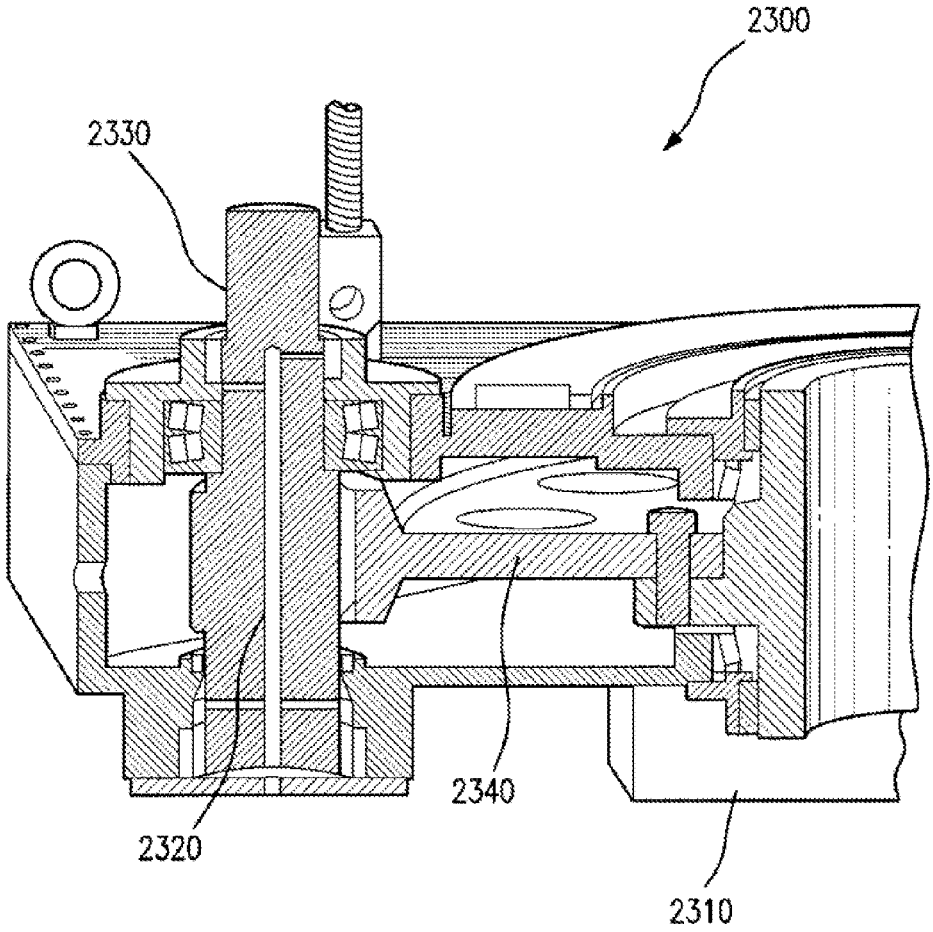
FIG. 4 is a partially cut away perspective view of one embodiment of a gearbox lubrication system.

In the gearbox lubrication system, the wear components from the gear that contaminate the lubricant generally require forced circulation and filtration. FIG. 4 shows an example embodiment of such a gearbox lubrication system 2300. The gearbox lubrication system 2300 may have an oil sump 2310, an oil passage 2320, one or more circulators (not shown) and one or more filters 2350, which serve to lubricate a contact surface between an input pinion 2330 and a bull gear 2340. Where a plurality of circulators and/or filters are used, they may be configured to create redundancy in the system.

In embodiments with an interchangeable washpipe, the washpipe may be changed very quickly so that the downtime is minimized. The change may be done remotely with automatic quick change capability.

The interchangeability of the various top drive modules may allow for repairs, maintenance, inspection, and/or operational reconfiguration to be performed off the critical path. This may reduce downtime for a modular top drive system, which corresponds to a reduced downtime for the entire rig. Some or all of the top drive modules may be symmetrical, allowing for installation in more than one location on the top drive.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. For example, the present invention may be used to run drill pipe, as well as casing, or other tubulars. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. Also, the terms in the claims have their plain, ordinary meaning unless otherwise explicitly and clearly defined by the patentee.

What is claimed is:

1. A top drive system comprising:

a top drive comprising a plurality of top drive modules on a critical path, the top drive modules comprising a motor module and a pipe handler module, the pipe handler module comprising a back-up wrench including a gripper, a link tilt assembly, and an elevator link support, wherein the motor module and the pipe handler module are removable from the top drive independent of each other; and a replacement top drive module that is not on the critical path, wherein the replacement top drive module is configured to be readily exchanged with its corresponding top drive module on the critical path.

2. A top drive system as claimed in claim 1, wherein the pipe handler module further comprises one or more of a mounting plate, a rotary manifold for hydraulic and air communication, an integrated link counter balance system, or an auto grease system, or a combination thereof.

3. The top drive system of claim 1, further comprising a replacement top drive that is not on the critical path, wherein the replacement top drive is configured to be readily exchanged in place of the top drive comprising the plurality of top drive modules on the critical path.

4. The top drive system of claim 1, wherein the plurality of top drive modules on the critical path further comprises at least one of a main body module, a gearbox module, a drive motor module, an upper fluid module, a lower well control valve module, a block interface module, a retract system interface frame module, a cooling system module, a work platform guard module, and a quill saver sub module.

5. A top drive system, comprising:

a top drive comprising a plurality of top drive modules on a critical path, the top drive modules comprising a motor module and a pipe handler module, wherein the motor module and the pipe handler module are removable from the top drive independent of each other; and a replacement top drive module that is not on the critical path, wherein the replacement top drive module is configured to be readily exchanged with at least one of the plurality of top drive modules on the critical path, and wherein the replacement top drive module is preconfigured for a different drilling application than at least one of the plurality of top drive modules on the critical path.

6. A top drive system comprising:

a top drive comprising a plurality of motor modules and one or more top drive modules including at least a pipe handler module adapted to be on or off critical path;

a plurality of circulators adapted to provide cooling to at least the plurality of motor modules; and a common duct communicably coupled to each of the plurality of circulators and at least each of the plurality of motor modules.

7. A top drive system as recited in claim 6, wherein the one or more top drive modules is on a critical path, and further comprising a replacement top drive module that is not on the critical path, wherein the replacement top drive module is configured to be readily exchanged with at least one of the one or more top drive modules on the critical path.

8. A top drive system as recited in claim 6, further comprising a plurality of interchangeable washpipes.

9. A top drive system as recited in claim 8, wherein the washpipes are configured to be changed remotely with automatic quick change capability.

10. The top drive system of claim 6, wherein the common duct extends through a support structure of the top drive and is operable to allow continued cooling from at least one non-failing circulator when one of the plurality of circulators fails.

11. A method of increasing drilling efficiency, which comprises:

providing a top drive comprising:

a pipe handler module comprising a back-up wrench including a gripper, a link tilt assembly, and an elevator link support, and at least one other top drive module, wherein said plurality of top drive modules is on a critical path, and wherein each of the plurality of top drive modules comprises at least one mechanical connection to the top drive, the at least one mechanical connection comprising at least one of a dovetail slide-on, a multi-unit retract system, an eccentric jam device, a keyway slot, pilot ring, clamp, a flange, pin, or slot;

providing a replacement top drive module off the critical path, wherein the replacement top drive module is configured to be readily exchanged with its corresponding top drive module;

replacing at least one of the plurality of top drive modules with the replacement top drive module such that the replacement top drive module is on the critical path and the replaced at least one of the plurality of top drive modules is off the critical path.

12. A method of increasing drilling efficiency as recited in claim 11, wherein the pipe handler module is selected to comprise one or more of a mounting plate, a rotary manifold for hydraulic and air communication, an integrated link counter balance system, or an auto grease system, or a combination thereof.

13. A method of increasing drilling efficiency as recited in claim 11, wherein the at least one other top drive module comprises a first and a second top drive module, wherein the second top drive module has the same function as the first top drive module, and the second top drive module continues to operate when the first top drive module fails to operate.

14. A method of increasing drilling efficiency as recited in claim 11, wherein the at least one other top drive module comprises a motor module and at least one module selected from the group consisting of a main body module, a gearbox module, an upper fluid module, a lower well control valve module, a block interface module, a retract system interface frame module, a cooling system module, a work platform guard module, and a quill saver sub module.

15. A method of increasing drilling efficiency as recited in claim 11, further comprising: repairing the replaced at least one of the plurality of top drive modules off the critical path.

16. A method of increasing drilling efficiency as recited in claim 11, further comprising: inspecting the replaced at least one of the plurality of top drive modules off the critical path.

17. A method of increasing drilling efficiency as recited in claim 11, further comprising: performing maintenance on the replaced at least one of the plurality of top drive modules off the critical path.

18. A method of increasing drilling efficiency as recited in claim 11, further comprising: diagnosing the replaced at least one of the plurality of top drive modules off the critical path.

19. A method of increasing drilling efficiency as recited in claim 11, further comprising: performing dual activities on at least one of the plurality of top drive modules.

20. A method of increasing drilling efficiency, which comprises:

providing a top drive comprising a pipe handler module and at least one other top drive module, wherein the pipe handler module and a first of at least one other top drive modules is on a critical path, a second of the at least one other top drive modules is off the critical path, a third of the at least one other top drive modules is on the critical path and can operate when the first and second top drive modules are not operating; and replacing the pipe handler module or the first of the at least one other top drive modules with the second top drive module such that the second top drive module is on the critical path and the replaced pipe handler module or first other top drive module is off the critical path.

21. A top drive system comprising:

a top drive comprising a plurality of top drive modules on a critical path, the top drive modules comprising a motor module and a pipe handler module, wherein the motor module and the pipe handler module are removable from the top drive independent of each other;

an auto grease system associated with one or more of the plurality of top drive modules and a replacement top drive module that is not on the critical path, wherein the replacement top drive module is configured to be readily exchanged with its corresponding top drive module on the critical path.

* * * * *